United States Patent [19]

Zucchinelli

[11] 4,029,987

[45] June 14, 1977

[54] WIDE CHANNEL GETTER DEVICE

[75] Inventor: Mario Zucchinelli, Milan, Italy

[73] Assignee: S.A.E.S. Getters S.p.A., Milan, Italy

[22] Filed: Apr. 16, 1975

[21] Appl. No.: 568,558

[30] Foreign Application Priority Data

Apr. 16, 1974 Italy ..... 21447/74

[52] U.S. Cl. ..... 313/174; 313/181; 313/481

[51] Int. Cl.[2] ..... H01J 19/70; H01J 29/94

[58] Field of Search ..... 313/174, 178, 180, 181, 313/481; 417/48

[56] References Cited

UNITED STATES PATENTS

| | | | |
|---|---|---|---|
| 2,869,014 | 1/1959 | Natalis | 313/181 |
| 2,907,451 | 10/1959 | Della Porta | 417/48 |
| 3,195,716 | 7/1965 | Della Porta | 417/48 |
| 3,385,420 | 5/1968 | Della Porta | 417/48 |
| 3,719,433 | 3/1973 | Rabusin | 313/181 X |
| 3,792,300 | 2/1974 | Benda et al. | 313/174 X |

FOREIGN PATENTS OR APPLICATIONS

| | | | |
|---|---|---|---|
| 235,993 | 10/1961 | Australia | 417/48 |
| 762,640 | 3/1966 | Italy | 416/48 |
| 934,983 | 8/1963 | United Kingdom | 417/48 |

*Primary Examiner*—Palmer C. Demeo
*Attorney, Agent, or Firm*—Littlepage, Quaintance, Murphy, Richardson & Webner

[57] ABSTRACT

The present invention relates to an improved getter device with a reduced tendency towards the formation of loose particles and lifting of getter material from its container. One embodiment provides an improvement in the distribution of evaporated getter metal.

16 Claims, 10 Drawing Figures

WIDE CHANNEL GETTER DEVICE

DISCLOSURE

Getter devices which release an evaporable getter metal in a vacuum are well known. The getter metal released by these devices deposits as a film on the inside walls of the vacuum vessel. These devices are commonly employed in electronic tubes in general and in cathode-ray tubes such as television tubes in particular.

In order to heat the getter device, to cause evaporation of the getter metal, it is customary to use induction heating and so the greater device is usually constructed in the form of a closed loop such as a U-shaped ring channel container supporting an evaporable getter material as a compressed powder. See for example U.S. Pat. No. 2,824,640 and U.S. Pat. No. 3,225,911.

The evaporable getter material generally comprises an alkaline earth metal such as magnesium, strontium or barium or their alloys. The most commonly used getter material is an alloy of barium with aluminum containing about 50–56% barium by weight. It is frequently desirable to mix this barium aluminum alloy with another material such that, upon heating, an exothermic chemical reaction takes place with release of barium vapor. Very often the material chosen is nickel which is added in an approximate weight ratio of 2:1 to 1:2 and preferably in a ratio of 1:1 with the barium aluminum alloy. Thus, the exothermic evaporable getter mixture contains about 25% by weight of barium.

Very frequently there is also added a small percentage of gas releasing material such as $Fe_4N$ or the hydrides of Ti or Zr.

In large size electron tubes, and particularly color television picture tubes, it is common to release up to about 250 mg of barium so as to ensure satisfactory gettering properties and a long cathode life. The use of 250 mg of barium implies that the getter device must contain a minimum of about 1000 mg of exothermic evaporable getter material. When such a large amount of getter material is disposed in a U-shaped channel holder several disadvantages may occur.

It has been found that if the thickness of the getter material, pressed into the U-channel holder, is too great there is a serious loss of barium yield. Frequently less than 100% of the theoretical barium content is evaporated upon heating with the normal flashing times.

In order to reduce the thickness of the getter material it has become common to use a U-channel holder with a wide channel such that the thickness to width ratio less than about 1:3 and preferably less than 1:4. The wide channel also allows a larger surface area of the evaporable getter material to be exposed thus facilitating barium evaporation upon heating. Unfortunately the use a wide channel has resulted in further disadvantages. There is a tendency for the getter material to crack and detach or lift from the holder. This can result in loose particles being released from the getter holder which particles can cause short circuits in the electrode structure or block the electron transparent holes in a color TV shadow mask. Furthermore, lifting of the evaporable getter material alters the thermal properties of the getter device and can lead to localized overheating and melting of the holder.

In the past much effort has been spent to try to overcome these and other problems and to obtain a high yield quick flash getter device.

Della Porta in U.S. Pat. No. 3,385,420 proposes the use of a getter material holder which allows a plurality of the getter material surfaces to be exposed.

King in U.S. Pat. No. 2,183,841 also proposed an increase in the surface area to overcome certain problems but this resulting device becomes cumbersome. Furthermore, he is not concerned with eliminating the lifting of getter material from a wide channel getter device.

Scott in U.S. Pat. No. 3,457,448 provides the getter device with a reinforcing means such as a bead formed in the outer wall of the U-channel support. Such heads are difficult to form in a resproducible manner and lifting of the getter still occurs.

Reash in U.S. Pat. No. 3,428,168 also provides a reinforcing means in the form of a wide or L-shaped annular metallic element placed within the getter holder.

Unfortunately prior attempts to reduce the propensity of the evaporable getter material to lift or detach itself from the support have met with only limited success.

Accordingly it is an object of the present invention to provide a getter device substantially free of one or more of the disadvantages of prior getter devices.

Another object is to provide an improved getter device in which separation of getter material from the holder is minimized.

A further object is to provide an improved getter device which has a reduced tendency to release loose particles.

A still further object of the present invention is to provide an improved getter device accomplishing the above objects without adversely affecting other properties such as the amount of getter metal released.

Additional objects and disadvantages of the present invention will be apparent to those skilled in the art by reference to the following detailed description hereof and drawings wherein.

Figure 1:
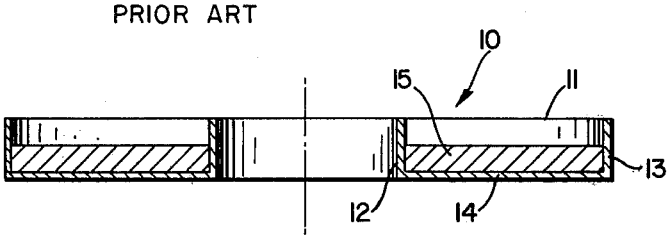
FIG. 1 PRIOR ART
FIG. 1 is a cross-sectional view of a prior art wide U-shaped ring channel getter device.

According to the present invention there is provided a getter device comprising an annular ring having:

1. an inner side wall
2. an outer side wall
3. a bottom wall for joining the inner wall to the outer wall 4. an evaporable getter material supported by said ring wherein the upper portion of the side walls disposed above said getter material are convergent relative to each other such that the area of the convergent walls projected perpendicularly onto the upper exposed surface area of said getter material is no more than 20% of said upper exposed surface area. By having such convergent side walls sufficient restraint is placed upon the getter material such that, upon heating to evaporate getter metal, the getter material does not lift away from the holder.

Furthermore, it has been found that if the perpendicular to the bottom wall of the annular ring is inclined at an angle to the ring axis, such that the intercept of the perpendicular with the ring axis is on the same of the getter device as the upper exposed surface of the getter material, there is even less tendency for the getter material to lift from the holder. This angle should be very small. Otherwise, the evaporating getter vapors will be directed in an undesired manner. An angle of about 2° has been found sufficient. However, angles up to about 10–15° can be used. At higher angels there may be given too great a directionality to the emitted vapors (see United Kingdom Patent 898,505).

The inner side wall of the annular ring holder may be conveniently formed round the perimeter of a disc member as described in U.S. Pat. No. 3,033,354. This disc member can also be integral with the inner side wall. Thus, the disc member can give mechanical rigidity to the inner side wall and it can also be used as a support for a separate deflecting shield such as described in UK Patent 1,348,692. The disc member may also be used to support other vapor releasing materials either on their own, mixed with other materials or held in a holder.

In order to further increase the exposed surface of the getter material the bottom wall of the holder may contain holes as described in U.S. Pat. No. 3,385,420.

When the bottom wall of the holder contains holes it is customary to provide a guide means for the evaporating vapors which is situated on the hole containing bottom wall of the holder. This guide means can also be used as a coupling element to couple the getter material holder to a support element. The support element may be in the form of a wire as shown in Pappadis, U.S. Pat. No. 3,508,105 or made of a material of low thermal conductivity and of high resistance to heating by induction currents.

In known devices this guide means or coupling element has been attached around substantially all its perimeter to the outer perimeter of the getter holder. However, in one preferred embodiment of the present invention at least part of the perimeter of the guide means is distanced from the perimeter of the getter material holder to act as a means for ensuring an evaporation of getter material vapors in a radial direction. At least part of the perimeter of the guide means should be attached to the perimeter of the holder to physically join them together in fixed relationship.

The exposed areas of the getter material may be protected by a layer of aluminum of thickness from 0.01 to 0.05 mm, or the getter material may be completely covered by the layer of Al.

Referring now to the drawings and in particular to FIG. 1 there is shown a cross-section of a known wide angle getter device 10, not forming part of the present invention in which the getter device comprises an annular ring 11 having an inner side wall 12, an outer side wall 13 and a bottom wall 14 joining said inner and outer side walls. An evaporable getter material 15 is supported by said ring.

Figure 2:
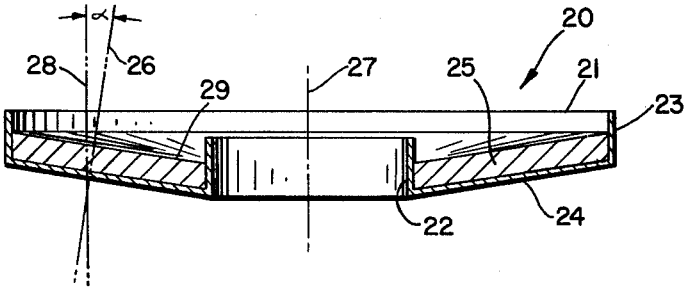
FIG. 2 is a cross-sectional view of one getter device of the present invention.

FIG. 2 shows a cross-sectional of a getter device 20 of the present invention which comprises an annular ring holder 21 having an inner side wall 22, an outer side wall 23 and a bottom wall 24. An evaporable getter material 25 is supported by said ring holder. The perpendicular 26 to the bottom wall 24 is inclined at an angle to the ring axis 27 or a line 28 parallel to the ring axis 27. Angle $\alpha$ is sufficiently small so as not to sensibly influence the direction of evaporation of the getter material upon heating the getter device, and the intercept of the perpendicular and the ring axis occurs on the same side of the getter device as is located the upper exposed surface area 29 of getter material 25.

Figure 3:
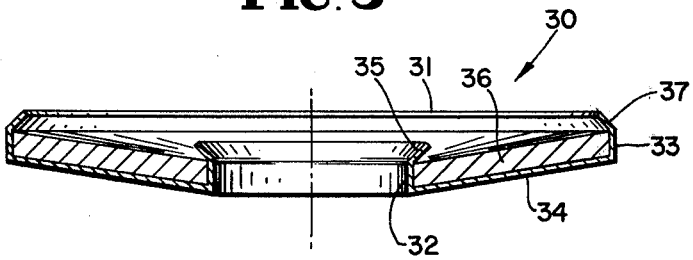
FIG. 3 is a cross-sectional view of another preferred getter device of the present invention.

FIG. 3 shows another embodiment of a getter device 30 of the present invention comprising an annular ring holder 31 having an inner side wall 32, an outer side wall 33 and a bottom wall 34. Inner side wall 32 has an upper portion 35 which is bent in such a direction as to partially overshadow the surface of the getter material 36 contained within the annular ring holder 31. Outer side wall 33 also has an upper portion 37 again bent in such a direction as to partially overshadow the surface of getter material 36. Again bottom wall 34 is inclined at an angle to the ring axis.

Figure 4:
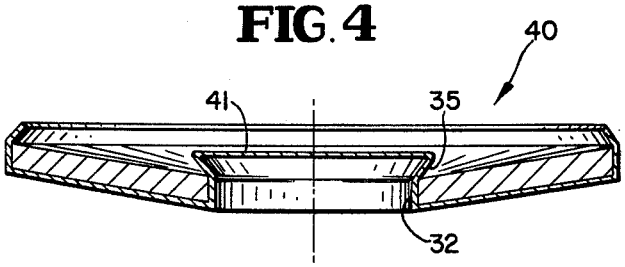
FIG. 4 is a cross-sectional view of a modified getter device of the present invention.

FIG. 4 shows a getter device 40, indentical in all respects to getter device 30 of FIG. 3 except that upper portion 35 of inner side wall 32 is formed integrally round a disc element 41.

Figure 5:
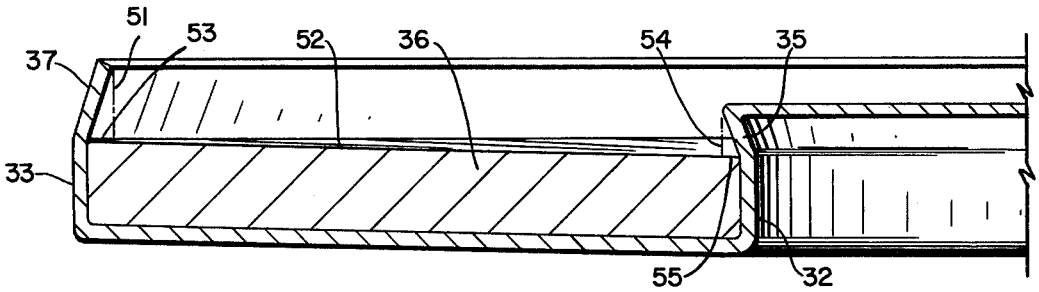
FIG. 5 is an enlarged view of the cross-section of FIG. 4.

FIG. 5 is an enlargement of a portion of getter device 40. Upper portion 37, of outer side wall 33, and upper portion 35 of inner side wall 32 are convergent towards each other. Upper portion 37 when projected perpendicularly (line 51) onto upper surface 52 of getter material 36 covers an area 53 of said upper surface. Similarly upper portion 35 when projected perpendicularly (line 54) covers an area 55. The sum of area 53 and 55 is no more than about 20% of exposed upper surface 52.

Figure 6:
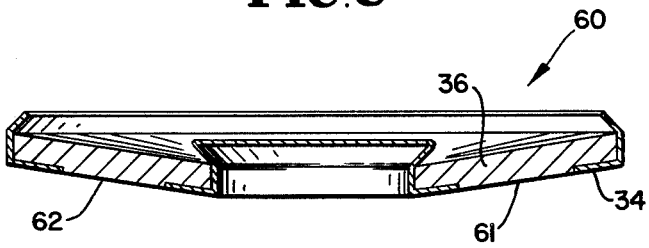
FIG. 6 is a cross-sectional view of a further getter device of the present invention.

FIG. 6 shows a preferred getter device 60, indentical in all respects to getter device 40 of FIG. 4 except that bottom wall 34 contains holes 61, 62 thus exposing a plurality of surfaces of getter material 36. In this case the exposed surfaces of said getter material are covered with a layer of aluminum 0.015 mm thick.

Figure 7:
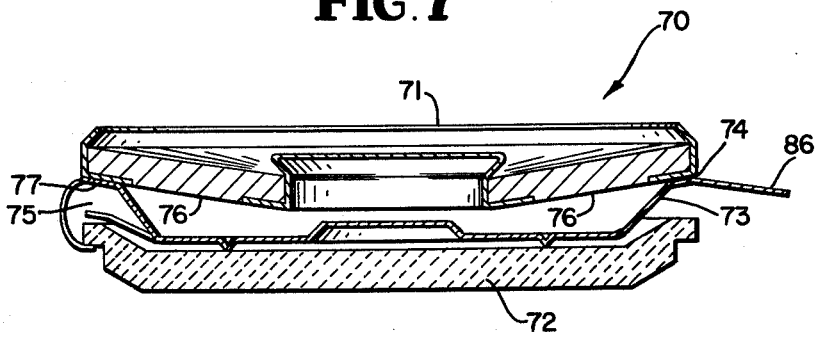
FIG. 7 is a cross-sectional view showing the use of a getter device of FIG. 6 in conjunction with a support means and a coupling element.

FIG. 7 shows a getter device 70 comprising an annular holder 71 identical in all respects to the holder of FIG. 6 except that there has been added a ceramic support means 72 substantially of the same diameter as the annular holder 71. Support means 72 is joined to holder 71 by means of coupling element 73 which is welded to annular holder 71 at position 74. Coupling element 73 is in the form of a shaped disc whose outer perimeter is substantially coextensive with the outer perimeter of said annular holder but also has at least one opening 75 between itself and annular ring 71 to radially direct vapors of getter metal which evaporate from holes 76 in the bottom of annular ring 71.

Figure 8:
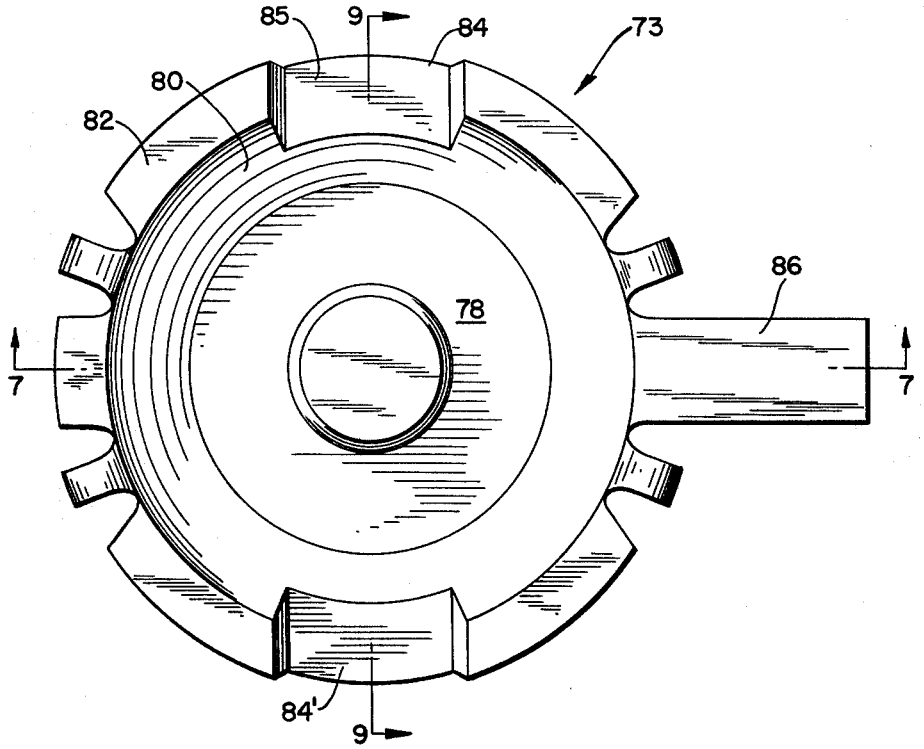
FIG. 8 is a plan view of a coupling element of the present invention.
Figure 9:
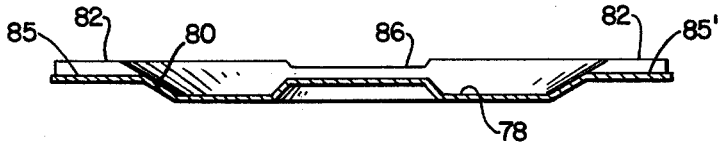
FIG. 9 is a sectional view of a coupling element of FIG. 8 taken along line 9—9 of FIG. 8.

Referring now to FIG. 8 there is shown a coupling element 73 useful in getter devices of the present invention. The coupling element 73 has a horizontally-disposed bottom 78 attached to a truncated conical section 80. A flat upper portion 82 is attached to the truncated conical section 80. The flat upper portion 82 is adjacent to two radially-extending depressions 84, 84'. The radially-extending depression 84 has a surface 85 intermediate between the horizontally-disposed bottom of the annular ring shown in FIG. 7 and the flat upper portion 82, thus forming a channel for radially directing getter metal vapors in a direction generally perpendicular to the tab 86. The coupling element 73 is preferably constructed of a single piece of sheet metal. It preferably has its outer periphery substantially coextensive with the outer side wall of the annular ring as shown in FIG. 7. As shown in FIG. 8 the flat upper portion 82 and the other corresponding flat upper portions are attached to the bottom wall of the annular ring in the vicinity of the outer side wall along the line radially outward from the openings in the bottom wall.

Figure 10:
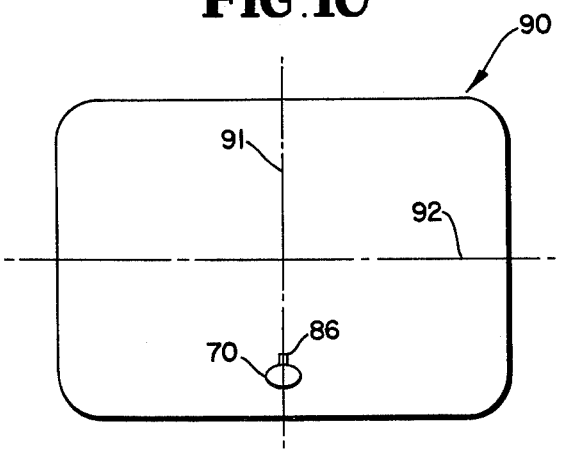
FIG. 10 is a view of the face of a television tube showing the manner in which the getter device of the present invention is utilized.

Referring now to FIG. 10 there is shown a front view of a TV tube 90. The TV tube 90 has a minor axis 91 and a major axis 92. The getter device 70 is mounted in the "antenna position" on the cone of the tube 90 by means of tab 86 to which is attached the spring-like extension (not shown) as is well known in the art. When so mounted the herein-described coupling element constitutes means for directing the getter metal vapor passing through the openings in the bottom wall of the annular ring in a direction substantially parallel to the major axis 92 of the television tube 90.

The invention will be further illustrated by the following examples in which all ratios are by weight unless otherwise stated.

EXAMPLE 1

Twenty getter devices of outside diameter 22 mm, and inside diameter 6 mm were constructed as descirbed in FIG. 7. The getter material comprised an alloy of Ba with aluminum in weight ratio 1:1. This alloy was powdered and mixed in a 1:1 ratio with powdered Ni. To this mixture was added about 2.4% $Fe_4N$. Each getter device contained 1000 mg of the mixture plus $Fe_4N$. The getter devices were placed in evacuated vessels and subjected to induction heating for 30 seconds at a sufficient power level to start barium evaporation after 10 seconds. Each getter device evaporated about 240 mg barium. The getter device produced no loose particles and the material remaining in the holder showed no signs of detaching or lifting from the holder.

EXAMPLE 2

Twenty getter devices of outside diameter 22 mm, inside diameter 6 mm are constructed as shown in FIG. 1. They are each filled with 1000 mg of material as described in Example 1. Using the same induction heating power level as in Example 1 the getter devices are heated in vacuum. All show signs of material detaching from the holder.

EXAMPLE 3

Twenty getter devices of outside diameter 22 mm, inside diameter 6 mm are constructed as shown in FIG. 2. They are each filled with 1000 mg of material as described in Example 1. Using the same induction heating power level as in Example 1 the getter devices are heated in vacuum. No signs of material detaching from the holder are observed.

EXAMPLE 4

Twenty getter devices of outside diameter 22 mm inside diameter 6 mm are constructed as shown in FIG. 3. They are each filled with 1000 mg of material as described in Example 1. Using the same induction heating power level the getter devices are heated in vacuum. No signs of material detaching from the holder are observed.

Although the present invention has been described in considerable detail with reference to certain preferred embodiments thereof, it will be understood that variations and modifications can be effected within the spirit and scope of the invention as described above and as defined in the appended claims.

What is claimed is:

1. A getter device comprising an annular ring having
   1. an inner side wall, 2. an outer side wall, 3. a bottom wall joining the outer wall to the inner wall,
   4. an evaporable getter material supported by said ring, characterized by the fact that the upper portion of the side walls disposed above said getter material are convergent relative to each other, the outer wall converging radially inwardly and upwardly, the inner wall converging radially outwardly and upwardly, such that the area of the convergent walls projected perpendicularly onto the upper exposed surface area of said getter material is no more than 20% of said upper exposed surface area.

2. A getter device of claim 1 in which the inner side wall is formed substantially around the perimeter of a disc member.

3. A getter device of claim 1 in which the bottom wall of the annular ring contains holes thereby exposing part of the lower surface area of getter material.

4. A getter device of claim 1 provided with a support element.

5. A getter device comprising:
   A. an annular ring having
      1. an inner side wall,
      2. an outer side wall,
      3. a bottom wall joining the outer wall to the inner wall,
      4. an evaporable getter material supported by said ring, wherein the upper portion of the side walls disposed above said getter material are convergent relative to each other, the outer wall converging radially inwardly and outwardly, the inner wall converging radially outwardly and upwardly, such that the area of the convergent wall projected perpendicularly onto the upper exposed surface area of said getter material is no more than 20% of the said upper exposed surface area,
   B. a support element,
   C. a coupling element joining said support element to said annular ring.

6. A getter device of claim 5 in which the support element is in the form of a shaped wire.

7. A getter device of claim 5 in which the support element is made of a material of low thermal conductivity and of high resistance to heating by induction currents.

8. A getter device comprising:
   A. an annular ring having
      1. an inner side wall,
      2. an outer side wall,
      3. a bottom wall containing holes joining the outer wall to the inner wall,
      4. an evaporable getter material supported by said ring,
   B. a support element, C. a coupling element joining said support element to said annular ring wherein the coupling element is substantially in form of a disc whose outer perimeter is substantially coextensive with the outer perimeter of the annular ring and having at least one opening between said coupling element and said annular ring for directing getter material vapors emitted from holes in the bottom wall of said annular ring in a substantially radial direction.

9. A getter device of claim 8 in which the inner side wall is formed substantially around the perimeter of a disc member.

10. A getter device of claim 9 in which the disc member is integral with the inner side wall.

11. A getter device of claim 8 in which the upper portion of the side walls disposed above the greater material are convergent relative to each other.

12. A getter device of claim 8 in which the perpendicular to the bottom wall of the annular ring is inclined at an angle to the ring axis.

13. A getter device comprising

A. an annular ring having 1. an inner side wall formed substantially around the perimeter of a disc member,
2. an outer side wall,
3. a bottom wall, containing at least one hole, joining the outer wall to the inner wall, wherein the perpendicular to the bottom wall of the annular ring is inclined at an angle to the ring axis such that the intercept of the perpendicular and the ring axis occurs on the same side of the getter device as the upper exposed surface area,
4. a barium vapor releasing material contained within said annular ring, wherein the upper portion of the side walls disposed above said getter material are convergent relative to each other such that the area of the convergent walls projected perpendicularly onto the upper exposed surface area of said getter material is no more than 20% of said upper exposed surface area, B. a support element of low thermal conductivity and of high resistance to heating by induction currents, C. a coupling element joining said support element to said annular ring wherein the coupling element is substantially in the form of a disc whose outer perimeter is substantially coextensive with the outer perimeter of the annular ring and having at least one opening between said coupling element and said annular ring for directing getter material vapors, emitted from said hole in the bottom wall of said annular ring, in a substantially radial direction.

14. In a rectangular television tube having a major axis and a minor axis and having a getter device comprising an annular ring said annular ring comprising 1. an inner side wall,
2. an outer side wall,
3. a bottom wall joining the outer wall to the inner wall,
4. an evaporable getter material supported by said ring, said annular ring having openings in the bottom wall of the ring through which getter metal vapor can pass, said getter device being mounted on the minor axis in the antenna position, the improvement comprising providing the getter device with means for directing the getter metal vapor passing through the holes in a direction radially outwardly and substantially parallel to the major axis of the television tube.

15. A getter device comprising:

A. an annular ring having 1. an inner side wall,
2. an outer side wall,
3. a bottom wall joining the outer side wall to the inner side wall, said bottom wall having openings therein,
4. an evaporable getter material supported by the ring, B. a support element, C. a coupling element joining the support element to the annular ring, said coupling element comprising:

1. a horizontally-disposed bottom,
2. a truncated conical section attached to the horizontally-disposed bottom,
3. a flat upper portion attached to the truncated conical section,
4. a first radially-extending depression having a surface intermediate between the horizontally-disposed bottom and the flat upper portion, forming a channel for radially directing getter metal vapor,
5. a second radially-extending depression having a surface intermediate between the horizontally-disposed bottom and the flat upper portion, form a channel for radially directing getter metal vapor.

16. A getter device comprising:

A. an annular ring having 1. an inner side wall,
2. an outer side wall,
3. a bottom wall joining the outer side wall to the inner side wall, said bottom wall having openings therein,
4. an evaporable getter material supported by the ring, B. a support element C. a coupling element joining said support element to said annular ring, said coupling element 1. having a tab for mounting the getter device,
2. formed of a single piece of sheet metal,
3. having its outer periphery substantially coextensive with the outer side wall of the annular ring,
4. spaced from the bottom wall in two segments disposed at right angles to the tab,
5. having its outer periphery attached to the bottom wall of the annular ring in the vicinity of the outer side wall along a line radially outward from the openings in the bottom wall in a substantially vapor-tight manner.

* * * * *